US006591590B1

(12) United States Patent
Henneberg

(10) Patent No.: US 6,591,590 B1
(45) Date of Patent: Jul. 15, 2003

(54) TRAINING REIN SYSTEM

(76) Inventor: Jill M. Henneberg, 4300 N. Meridian Rd., Tallahassee, FL (US) 32312

( * ) Notice: Subject to any disclaimer, the term of this patent is extended or adjusted under 35 U.S.C. 154(b) by 0 days.

(21) Appl. No.: 10/228,324

(22) Filed: Aug. 26, 2002

(51) Int. Cl.[7] ..... B68B 1/00; A63B 57/00
(52) U.S. Cl. ..... 54/36; 473/205
(58) Field of Search ..... 54/6.1, 36, 73, 54/74; 473/205, 206

(56) References Cited

U.S. PATENT DOCUMENTS

| | | | | | |
|---|---|---|---|---|---|
| 108,638 | A | | 10/1870 | Scott | |
| 148,550 | A | | 3/1874 | Cook | |
| 501,308 | A | * | 7/1893 | Whiting | 54/74 |
| 619,982 | A | * | 2/1899 | McCombs et al. | 54/74 |
| 3,348,238 | A | | 10/1967 | Hydock | 2/161 |
| 3,532,344 | A | | 10/1970 | Masstab | |
| 5,148,656 | A | | 9/1992 | Meaghan | 54/36 |
| 5,232,225 | A | | 8/1993 | Snyder | |
| 5,423,164 | A | | 6/1995 | Schneider | 54/44.1 |
| 5,435,013 | A | | 7/1995 | Davis | 2/161.1 |
| 5,442,900 | A | * | 8/1995 | Ciampi | 54/36 |
| 5,462,280 | A | | 10/1995 | Dickerson | |
| 5,901,531 | A | | 5/1999 | Rogers | 54/44.1 |
| 5,946,721 | A | * | 9/1999 | Dance | 2/69 |
| 6,085,500 | A | | 7/2000 | Keppick | 54/71 |

* cited by examiner

*Primary Examiner*—Charles T. Jordan
*Assistant Examiner*—Elizabeth Shaw
(74) *Attorney, Agent, or Firm*—Peter Loffler

(57) ABSTRACT

A horse training system uses a set of reins that are attachable to a bit to form a loop, with the reins having a left gripping section and a right gripping section. A pair of gloves are worn by the rider with each glove having a mechanical fastener thereon such that when the user grasps the reins while wearing the gloves, the gloves and thus the rider's hands, are mechanically fastened to the reins.

18 Claims, 2 Drawing Sheets

TRAINING REIN SYSTEM

BACKGROUND OF THE INVENTION

1. Field of the Invention

The present invention relates to horse riding rein system that trains a user in the proper placement and maintenance of the user's hands upon the reins while riding a horse.

2. Background of the Prior Art

Elegant and sophisticated in appearance, horse riding is a rather complicated art form to master. Attaining good horsemanship is not only important to the competitive rider, it is also important to the casual rider for safety of the rider as well as comfort of the horse. The riding reins are a key element in horse control and thus in attaining good horsemanship. The reins of a rider act in somewhat similar fashion to the steering wheel of a vehicle in that the reins help guide and control the actions of the horse. Therefore, in mastering good horsemanship it is necessary to have achieve mastery of the reins.

One aspect of proper rein control is proper hand placement upon the reins. The reins have two ends which are attachable to a bit in order to form a loop. Each side of the reins has a gripping section whereat the hands of the rider are to be placed. Placement of the hands within a particular portion of the gripping section is dependent on the maneuvers to be performed. For example, if the rider is performing dressage wherein tight maneuvers and sharp turns are to be performed, the rider wants to place her hands on the upper portion of the gripping section—relatively closer to the bit—in order to have a more firm control of the horse, while a rider that is galloping cross-country, wherein long straightaways and gradual turns are to be expected, places her hands on the lower portion of the gripping section—relatively farther from the bit—in order to allow the horse to have more freedom.

While proper hand placement on the reins is second nature to experienced riders, proper hand placement can prove quite tricky to the beginning rider. Although riders understand the proper desired location of their hands during riding, executing theory into fact is oftentimes quite difficult. A rider will start a riding session with proper hand placement, but after an executed difficult maneuver, or an unexpected occurrence, will allow her hands to slip, either upwardly or downwardly along the reins, away from the desired location, thus not maintaining consistent contact with the hourse's mouth.

Devices have been proposed that assist in proper hand placement on the reins during a ride. Some such devices use a mechanical barrier between adjoining hand grip portions on the rein that help prevent the hands of the rider from slipping from one portion to another during a ride. Other such devices utilize a tactile signaling method whereby a rider is able to tactilely determine if her hands are on the appropriate section of the reins.

Such prior devices give a rider feedback about hand placement, and if hand placement is incorrect, allow the rider to correct the hand placement on the reins. However, the prior art devices fail to help the rider maintain a firm grasp of the appropriate portion of the reins during a ride in order to develop the proper rein feel and muscle memory.

Therefore, there exists a need in the art for a device that allows a rider to position her hands on the appropriate portion of the gripping section of the reins and to maintain her hands threat during tricky or otherwise high pressure maneuvers. Such a device must be of relatively simple design and construction and must be easy to use.

SUMMARY OF THE INVENTION

The training rein system of the present invention addresses the aforementioned needs in the art. The training rein system allows a rider to position her hands on the appropriate portion of the gripping section of the reins and to maintain her hands thereat during tricky or otherwise high pressure maneuvers. The training rein system is of relatively simple design and construction and is easy to use.

The training rein system of the present invention is comprised of a set of reins, in combination with a left glove and a right glove, each glove to be worn by a rider, the set of reins attachable to a bit on a horse to thereby form a loop, the set of reins having a left side and a ride side, the left side having a left gripping section with a first portion and a second portion and the right side having a right gripping section with a third portion and a fourth portion, such that the left glove has a first mechanical fastener thereon and the right glove has a second mechanical fastener thereon such that when the left glove is worn on the left hand of the rider and the right glove is worn on the right hand of the rider and the rider grasps the left gripping section with the left hand, the left glove is mechanically fastened to the left gripping section, and when the rider grasps the right gripping section with the right glove, the right glove is mechanically fastened to the right gripping section. A first divider can be positioned between the first portion and the second portion of the left gripping section while a second divider can be positioned between the third portion and the fourth portion of the right gripping section. The first divider can form a first mechanical barrier between the first portion and the second portion and the second divider can form a second mechanical barrier between the third portion and the fourth portion. The first divider may be of a different color relative to the first portion and the second portion and the second divider may be of a different color relative to the third portion and the fourth portion. The first mechanical fastener may comprise a first portion of cooperating hook and loop material disposed on the left glove and a corresponding second portion of cooperating hook and loop material located on the left gripping portion of the reins and the second mechanical fastener may comprise a third portion of cooperating hook and loop material disposed on the right glove and a corresponding fourth portion of cooperating hook and loop material located on the right gripping portion. Alternately, the first mechanical fastener may comprise a first adhesive tape portion located a palm portion of the left glove such that the first adhesive tape portion contacts the left gripping section whenever the rider grasps the left gripping section with the left glove and the second mechanical fastener may comprise a second adhesive tape portion located a palm portion of the right glove such that the second adhesive tape portion contacts the right gripping section whenever the rider grasps the right gripping section with the right glove.

BRIEF DESCRIPTION OF THE DRAWINGS

Similar reference numerals refer to similar parts throughout the several views of the drawings.

DESCRIPTION OF THE PREFERRED EMBODIMENT

Figure 1:
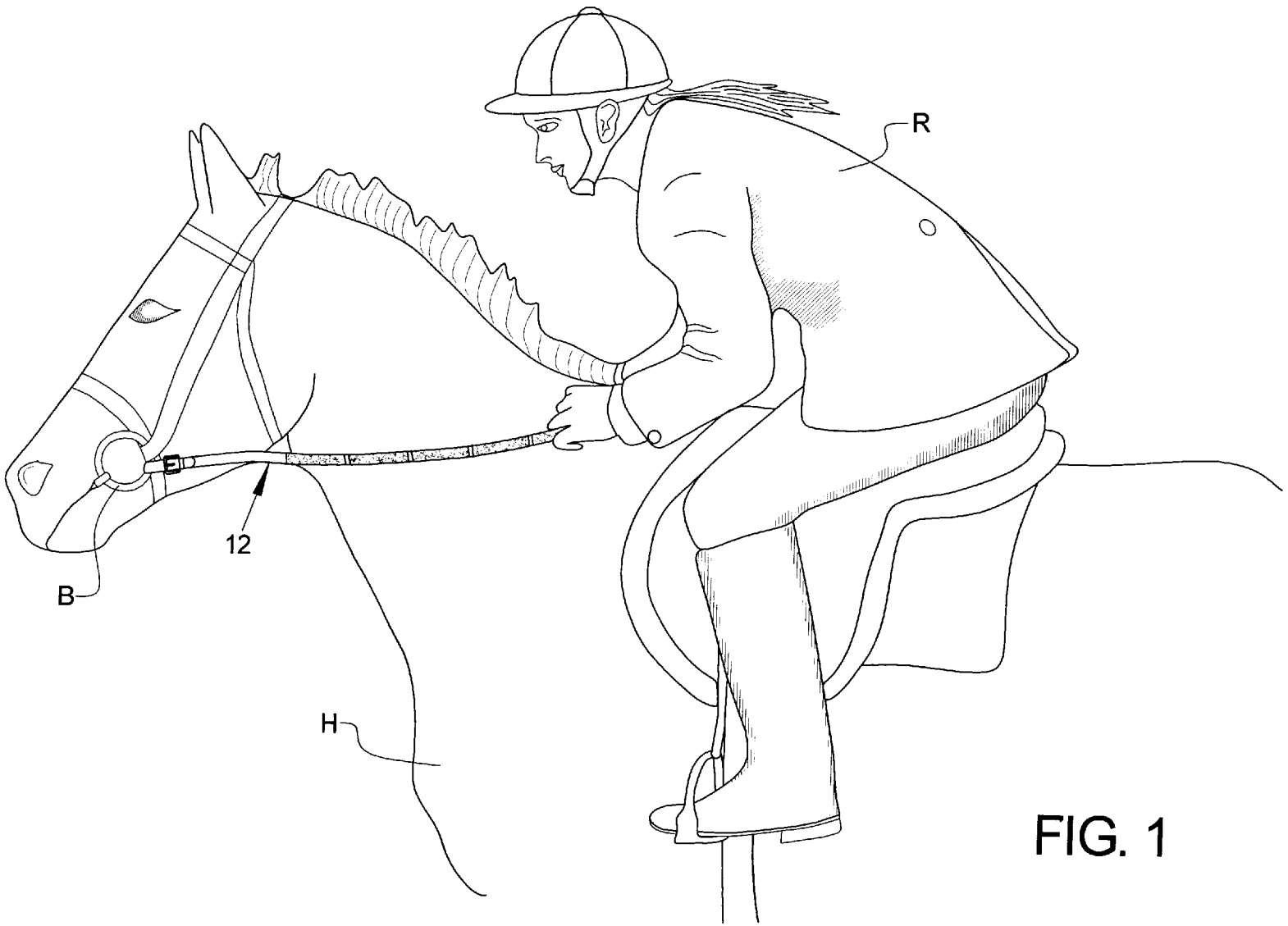
FIG. 1 is an environmental view of the training rein system of the present invention being utilized by a horse rider.
Figure 2:
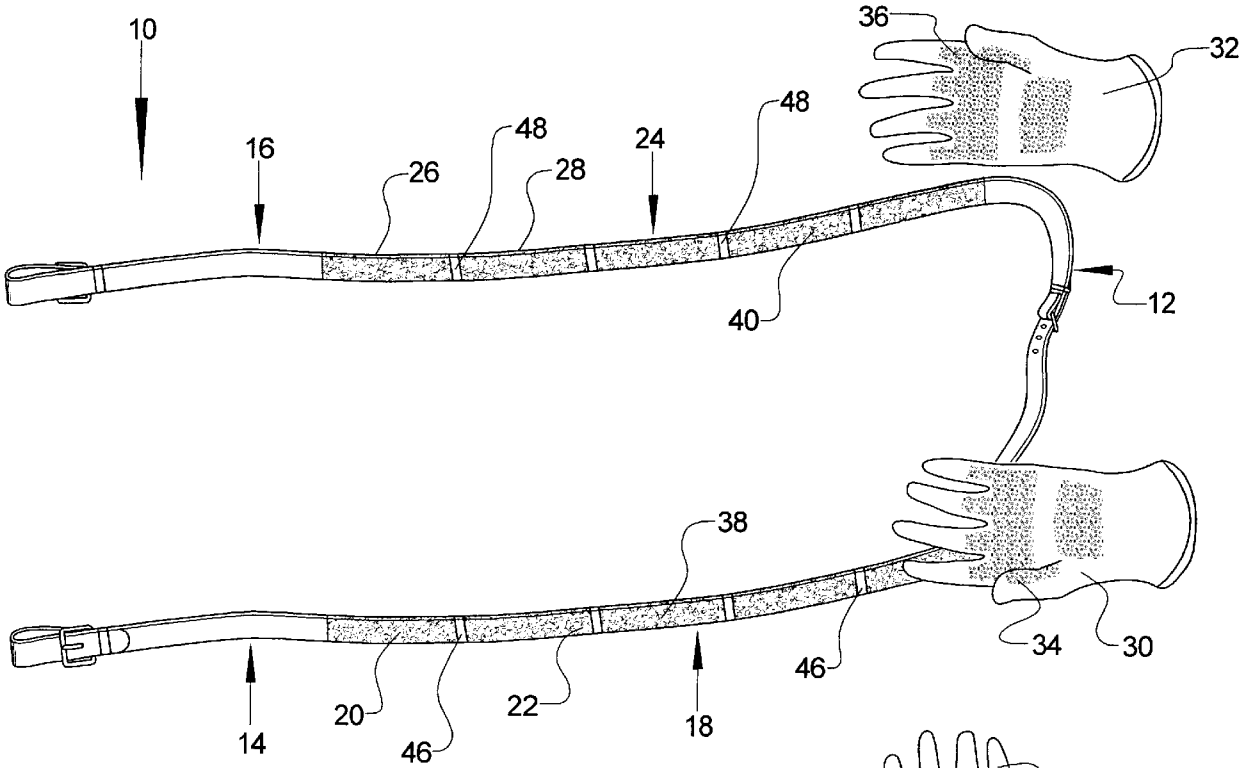
FIG. 2 is a perspective view of the training rein system of the present invention.
Figure 3:
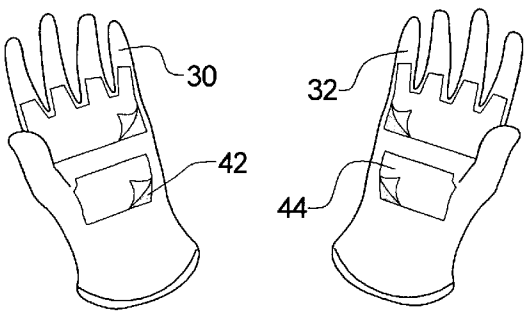
FIG. 3 is a perspective view of the gloves of the training rein system using an adhesive tape mechanical fastener.

Referring now to the drawings, it is seen that the training rein system and method of the present invention, generally denoted by reference numeral 10, is comprised of a set of reins 12 attachable to a bit B on a horse H to thereby form a loop, the set of reins 12 having a left side 14 and a right side 16, the left side 14 having a left gripping section 18 with a first portion 20 and a second portion 22 and the right side 16 having a right gripping section 24 with a third portion 26 and a fourth portion 28. A left glove 30 is provided and is worn on the left hand of a rider R while a right glove 32 is provided and is worn on the right hand of the rider R. The left glove 30 has a first mechanical fastener 34 on its palm portion while the right glove 32 has a second mechanical fastener 36 on its palm portion such that when the left glove 30 is worn on the left hand of the rider R and the right glove 32 is worn on the right hand of the rider R and the rider R grasps the left gripping section 18 with the left hand, the left glove 30 is mechanically fastened to the left gripping section 18, and when the rider R grasps the right gripping section 24 with the right glove 32, the right glove 32 is mechanically fastened to the right gripping section 24.

The first mechanical fastener 34 may comprise a first portion of cooperating hook and loop material disposed on the left glove 30 and a corresponding second portion of cooperating hook and loop material 38 located on the left gripping portion 18 of the reins 12 and the second mechanical fastener 36 may comprise a third portion of cooperating hook and loop material disposed on the right glove 32 and a corresponding fourth portion of cooperating hook and loop material 40 located on the right gripping portion 24. As the rider R grasps the appropriate portion of the left gripping section 18 with her left glove 30, the first portion of hook and loop material cooperatively mates with the second portion of hook and loop material 38 and the rider R grasps the appropriate portion of the right gripping section 24 with her right glove 32, the third portion of hook and loop material cooperatively mates with the fourth portion of hook and loop material 40. This helps maintain the rider's hands on the appropriate portion of each gripping section 18 and 24 even when the rider R is performing a difficult maneuver and turns her concentration to the maneuver and away from hand placement on the reins 12. The bonds of the hook and loop material are sufficiently strong to help hold the rider's hands on the reins 12 during most maneuvers yet not so strong such that if the rider R is thrown from the horse H, her hands break free from the reins 12 relatively easily.

Alternately, the first mechanical fastener 34 may comprise a first adhesive tape portion 42 located a palm portion of the left glove 30 such that the first adhesive tape portion 42 contacts the left gripping section 18 whenever the rider R grasps the left gripping section 18 with the left glove 30 and the second mechanical fastener 36 may comprise a second adhesive tape portion 44 located a palm portion of the right glove 32 such that the second adhesive tape portion 44 contacts the right gripping section 24 whenever the rider R grasps the right gripping section 24 with the right glove 32. The adhesive grip strength of the first adhesive tape portion 42 and the second adhesive tape portion 44 are each sufficiently strong to help hold the rider's hands on the reins 12 during most maneuvers yet not so strong such that if the rider R is thrown from the horse H, her hands break free from the reins 12 relatively easily.

If desired, a first divider 46 can be positioned between the first portion 20 and the second portion 22 of the left gripping section 18 while a second divider 48 can be positioned between the third portion 26 and the fourth portion 28 of the right gripping section 24. The dividers 46 and 48 can be used as either a visual or tactile sensor for further aiding the rider R in proper hand placement such that the first divider 46 can form a first mechanical barrier between the first portion 20 and the second portion 22 and the second divider 48 can form a second mechanical barrier between the third portion 26 and the fourth portion 28 and alternately or in addition, the first divider 46 may be of a different color relative to the first portion 20 and the second portion 22 and the second divider 48 may be of a different color relative to the third portion 26 and the fourth portion 28. Accordingly, if the two dividers 46 and 48 form mechanical barriers (for example, the dividers 46 and 48 can be formed as raised portions with respect to the remainder of their respective gripping section 18 and 24), the rider R will tactilely sense each divider 46 and 48 when placing her hands on the reins 12, allowing her to properly place her hands on the appropriate portion of each gripping section 18 and 24. If the dividers 46 and 48 are of a different color with respect to the remainder of their respective gripping section 18 and 24, the difference in the colors will help the rider R visually guide her hands to the appropriate portions of each gripping section.

While the invention has been particularly shown and described with reference to an embodiment thereof, it will be appreciated by those skilled in the art that various changes in form and detail may be made without departing from the spirit and scope of the invention.

I claim:

1. A set of reins, in combination with at least one glove to be worn by a rider, the set of reins attachable to a bit on a horse to thereby form a loop, the set of reins having a left side and a ride side, the left side having a first gripping section with a first portion and a second portion and the right side having a second gripping section with a third portion and a fourth portion such that the at least one glove has a mechanical fastener thereon such that when the glove is worn by the rider and the rider grasps one of the first gripping section or the second gripping section with the glove, the glove is mechanically fastened to the appropriate gripping section.

2. The reins as in claim 1 further comprising:

a first divider positioned between the first portion and the second portion of the first gripping section; and a second divider positioned between the third portion and the fourth portion of the second gripping section.

3. The reins as in claim 2 wherein the first divider forms a first mechanical barrier between the first portion and the second portion and the second divider forms a second mechanical barrier between the third portion and the fourth portion.

4. The reins as in claim 2 wherein the first divider is of a different color relative to the first portion and the second portion and the second divider is of a different color relative to the third portion and the fourth portion.

5. The reins as in claim 1 wherein the mechanical fastener comprises:

a first portion of cooperating hook and loop material disposed on the glove; and a corresponding second portion of cooperating hook and loop material located on each of the first gripping portion and the second gripping portion.

6. The reins as in claim 1 wherein the mechanical fastener comprises an adhesive tape portion located on a palm portion of the glove such that the adhesive tape portion contacts the reins whenever the rider grasps the reins with the glove.

7. A set of reins, in combination with a left glove to be worn on a left hand of a rider and a right glove to be worn on a right hand of the rider, the set of reins attachable to a bit on a horse to thereby form a loop, the set of reins having a left side and a ride side, the left side having a left gripping section with a first portion and a second portion and the right side having a right gripping section with a third portion and a fourth portion such that the left glove has a first mechanical fastener thereon and the right glove has a second mechanical fastener thereon such that when the left glove is worn on the left hand of the rider and the right glove is worn on the right hand of the rider and the rider grasps the left gripping section with the left hand, the left glove is mechanically fastened to the left gripping section, and rider grasps the right gripping section with the right glove, the right glove is mechanically fastened to the right gripping section.

8. The reins as in claim 7 further comprising:

a first divider positioned between the first portion and the second portion of the left gripping section; and a second divider positioned between the third portion and the fourth portion of the right gripping section.

9. The reins as in claim 8 wherein the first divider forms a first mechanical barrier between the first portion and the second portion and the second divider forms a second mechanical barrier between the third portion and the fourth portion.

10. The reins as in claim 8 wherein the first divider is of a different color relative to the first portion and the second portion and the second divider is of a different color relative to the third portion and the fourth portion.

11. The reins as in claim 7 wherein the first mechanical fastener comprises a first portion of cooperating hook and loop material disposed on the left glove and a corresponding second portion of cooperating hook and loop material located on the left gripping portion and the second mechanical fastener comprises a third portion of cooperating hook and loop material disposed on the right glove and a corresponding fourth portion of cooperating hook and loop material located on the right gripping portion.

12. The reins as in claim 7 wherein the first mechanical fastener comprises a first adhesive tape portion located on a palm portion of the left glove such that the first adhesive tape portion contacts the left gripping section whenever the rider grasps the left gripping section with the left glove and the second mechanical fastener comprises a second adhesive tape portion located a palm portion of the right glove such that the second adhesive tape portion contacts the right gripping section whenever the rider grasps the right gripping section with the right glove.

13. A method for controlling and maneuvering a horse comprising the steps of:

providing a set of reins attachable to a bit on the horse to thereby form a loop, the set of reins having a left side and a ride side, the left side having a first gripping section with a left portion and a right portion and the right side having a second gripping section with a third portion and a fourth portion providing a left glove to be worn on the left hand of the rider such that the left glove has a first mechanical fastener thereon such that when the left glove is worn on the left hand of the rider and the rider grasps the left gripping section with the left hand the left glove is mechanically fastened to the left gripping section; and providing a right glove to be worn on the right hand of the rider such that the right glove has a second mechanical fastener thereon such that when the right glove is worn on the right hand of the rider and the rider grasps the right gripping section with the right hand the right glove is mechanically fastened to the right gripping section.

14. The method as in claim 13 further comprising the steps of:

providing a first divider positioned between the first portion and the second portion of the left gripping section; and providing a second divider positioned between the third portion and the fourth portion of the right gripping section.

15. The method as in claim 14 wherein the first divider forms a first mechanical barrier between the first portion and the second portion and the second divider forms a second mechanical barrier between the third portion and the fourth portion.

16. The method as in claim 14 wherein the first divider is of a different color relative to the first portion and the second portion and the second divider is of a different color relative to the third portion and the fourth portion.

17. The method as in claim 13 wherein the first mechanical fastener comprises a first portion of cooperating hook and loop material disposed on the left glove and a corresponding second portion of cooperating hook and loop material located on the left gripping portion and the second mechanical fastener comprises a third portion of cooperating hook and loop material disposed on the right glove and a corresponding fourth portion of cooperating hook and loop material located on the right gripping portion.

18. The method as in claim 13 wherein the first mechanical fastener comprises a first adhesive tape portion located on a palm portion of the left glove such that the first adhesive tape portion contacts the left gripping section whenever the rider grasps the left gripping section with the left glove and the second mechanical fastener comprises a second adhesive tape portion located on a palm portion of the right glove such that the second adhesive tape portion contacts the right gripping section whenever the rider grasps the right gripping section with the right glove.

* * * * *